US006779587B2

(12) United States Patent
Weyer et al.

(10) Patent No.: US 6,779,587 B2
(45) Date of Patent: Aug. 24, 2004

(54) METHOD AND DEVICE FOR ADJUSTING ONE OR MORE ROLL SEGMENTS IN A CONTINUOUS CASTING INSTALLATION FOR CASTING METALS, ESPECIALLY FOR STEEL MATERIALS

(75) Inventors: Axel Weyer, Wuppertal (DE); Horst von Wyl, Duisburg (DE); Wolfgang Schmitz, Meeerbusch (DE); Dieter Böttger, Düsseldorf (DE); Axel Selke, Duisburg (DE); Peter Schmidt, Voerde (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/276,933

(22) PCT Filed: May 11, 2001

(86) PCT No.: PCT/EP01/05384

§ 371 (c)(1),
(2), (4) Date: May 16, 2003

(87) PCT Pub. No.: WO01/89742

PCT Pub. Date: Nov. 29, 2001

(65) Prior Publication Data

US 2003/0178171 A1 Sep. 25, 2003

(51) Int. Cl.[7] ..... B22D 11/128; B22D 11/20

(52) U.S. Cl. ..... 164/454; 164/413; 164/442

(58) Field of Search ..... 164/454, 441, 164/442, 413, 484

(56) References Cited

U.S. PATENT DOCUMENTS

| | | | | |
|---|---|---|---|---|
| 6,386,268 | B1 * | 5/2002 | Weyer et al. | 164/454 |
| 6,540,010 | B1 * | 4/2003 | Geerkens et al. | 164/413 |
| 2002/0005266 | A1 * | 1/2002 | Pleschiutschnigg et al. | 164/442 |

* cited by examiner

*Primary Examiner*—Kuang Y. Lin
(74) *Attorney, Agent, or Firm*—Sidley Austin Brown & Wood, LLP

(57) ABSTRACT

A method and a device for adjusting one or more roll segments (1) in a continuous casting installation for metals, especially for steel materials, the rolls **(1*a*) of which adjusted in the segment upper frame (2) and the segment lower frame (3) on frame cross members (5) by pairs (4) of hydraulic piston-cylinder units in a position-and/or pressure-controlled manner, wherein an operation for guiding and/or pressing the casting strands (6) is switched from a position-controlled to a pressure-controlled operation when pressure within the respective pair (4) of piston-cylinder units reaches a predetermined maximum value, whereby an improved reaction is effected by operating the piston-cylinder unit of every roll segment (1) in the case of overload, in subsequent steps at a reduced pressure or in a pressureless switching mode until the switching mode is reached in which the segment upper frame (2)** can be opened to some extent.

7 Claims, 6 Drawing Sheets

METHOD AND DEVICE FOR ADJUSTING ONE OR MORE ROLL SEGMENTS IN A CONTINUOUS CASTING INSTALLATION FOR CASTING METALS, ESPECIALLY FOR STEEL MATERIALS

BACKGROUND OF THE INVENTION

1. Field of the Invention

The invention relates to method of and to a device for adjusting one or more roll segments in a continuous casting installation for metals, especially for steel materials, the rolls of which are adjusted in the segment upper frame and the segment lower frame on frame cross members by pairs of hydraulic piston-cylinder units in a position-and/or pressure-controlled manner, wherein an operation for guiding and/or pressing the casting strands is switched from a position-controlled to a pressure-controlled operation when the pressure within the respective pair of piston-cylinder units reaches a predetermined maximum value.

2. Description of the Prior Art

In a method for guiding a cast strand with an associated strand guide, the opening width, which corresponds to the thickness of the cast strand, is continuously adjusted during casting so that with a strand guide segment having four piston-cylinder units, two adjacent servo-piston-cylinder units, which are hydraulically combined with each other, are adjusted in accordance with the strand, and the remaining servo-piston-cylinder units are adjusted independently (DE 196 27 336C1).

Proceeding from this known method, WO 99/46 071 discloses the method described at the beginning. However, the known method and strand guides do not encompass all operational processes. In the roll casing, the existing forces are transmitted from the strand guide roll by a roller or slide bearing to a respective frame cross-member. During an operation, which often lasts several days or weeks without an interruption, stresses of different type and magnitude occur. Therefore, operational conditions most often occur which are caused by particularly high loads. Such operational conditions occur during casting at transition from a cold strand head to a hot strand, are caused, during composite casting, by a connection element between the melts of different steel products, and occur when the casting ends, i.e., are caused by strand ends. The strand shape of the transition piece and a ski shape generate particularly high loads. The resulting geometry of a cast strand is transported through the entire casting installation and passes every roll segment which results in different local load conditions. Simultaneously, a continuous strand displacement and suppression of the strand bulging in insured by the ferrostatic pressure. These conditions require particular measures.

The object of the invention is to compensate an overload that occurred previously, by an effective reaction of respective roll segments, i.e., to provide far-reaching protective measures.

SUMMARY OF THE INVENTION

The object of the invention is achieved by operating, in the case of overload, the piston-cylinder units of every roll segment in subsequent steps at a reduced pressure or in a pressureless switching mode until the switching mode is reached in which the segment upper frame can be opened to some extent. Thereby, an effective reaction of the roll segments at an increasing load is achieved in response to local load forces, i.e., a controlled reduction of the incoming overload takes place. The segment upper frames with rolls and bearings actively reduce, at the switching "open", the build-up overload.

This regulation possibility is expanded due to the fact that in the pressureless switching condition, the weight of the segment upper frame and friction forces of the relative displacement of the cylinder and the piston of a piston-cylinder unit provide for a locking force.

In order, however, to insure that the "softeners" of the adjusting force would not remain unmeasured, it is proposed to retain a maximum gap between the roll segments and the cast strand at a limited opening of the segment upper frame in the switching mode. Thereby, the set withdrawal or run-in path includes, for all cases, only a small portion of the entire available run-in path. In case this small run-in path is not retained, the strand would bulge in an unpermissible high region at an affected point, and the casting process would not be able to continue.

A device for adjusting one or more roll segment in a continuous casting installation for metals, especially for steel materials, proceeds from a device the rolls of which are adjusted in the segment upper frame and the segment lower frame on frame cross member by pairs of hydraulic piston-cylinder units in a position-and/or pressure-controlled manner, wherein an operation for guiding and/or pressing the casting strands is switched form a position-controlled to a pressure-controlled operation when the pressure within the respective pair of piston-cylinder units reaches a predetermined maximum value. The object of the invention with respect to the device is achieved by providing an adjustable displacement stop in the path of the segment upper frame. Thereby, the segment upper frame is not displaced over the entire possible run-in path.

In order to avoid a need in additional necessary constructional space, it is proposed to arrange the displacement stop between the segment upper frame and the segment lower frame.

According to further features, the displacement stop is advantageously arranged in immediate vicinity of every piston-cylinder unit. With four piston-cylinder units, each piston-cylinder unit includes such a displacement stop.

A displacement stop consisting of a pivoted-in and a pivoted-out toggle lever a pivot axis of which with a first lever arm is supported on the segment lower frame and its second lever arm lies below the segment upper frame in a pivoted-in position, proved itself in practice. The displacement stops are only pivoted in for a casting operation. During maintenance shifts, the displacement stop can be pivoted out, whereby a complete opening and a complete displacement of the segment upper frame can be effected for effecting a maintenance work.

According to other features, the displacement limitation is defined by an abutment mounted on the segment upper frame and forming a predetermined gap.

The gap can be formed by stacking on the abutment of the segment upper frame a plurality of shims for forming a changeable step-by-step gap. For each segment upper frame or for each piston-cylinder unit, the number and thickness of the shims is individually selected. Thereby, it is possible to provide an individual adjustment of a basic set-up of a displacement limitation for each roll segment or for each piston-cylinder unit at the entry side of the cast strand and at the exit side of the cast strand.

A further improvement according to the invention consists in forming the displacement stop simultaneously as an overload protection element, with the toggle lever being provided with a predetermined breaking point. In this way, the roll segment can be additionally protected from extreme overloads (so-called special casting cases).

BRIEF DESCRIPTION OF THE DRAWINGS

The drawings show an embodiment of the invention which would be explained in detail further below.

The drawings show.

DETAILED DESCRIPTION OF THE PREFERRED EMBODIMENTS

Figure 1C:
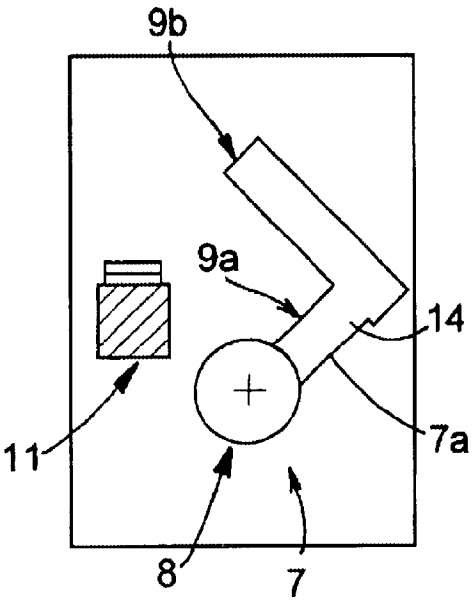
FIG. 1A a side view of a roll segment in a locking position.
FIG. 1B a detail "A" according to FIG. 1A at an increased scale with the displacement stop in the locking position, FIG. 1C the same detail "A" with the displacement stop outside of the locking position for maintenance work, FIG. 2A a front view of a roll segment in the locking position, with the displacement stop shown in side view, FIG. 2B a front view of a roll segment at maximum opening, FIG. 3 side view of a roll segment without the displacement stop, FIG. 4A a front view of a roll segment in a locking position without the displacement stop, FIG. 4B a front view of a roll segment outside of the locking position in a completely open position, FIG. 5 a side view of a roll segment with a point of application of the displacement stop, FIG. 6A a detail of the support of a toggle lever, and FIG. 6B a side view of the support of the toggle lever according to FIG. 6A.

A device according to the present invention, which is shown in FIG. 1, is used in a continuous casting installation for casting metals, in particular steel materials, and serves for adjusting one or more roll segments 1, with each roll segment 1 having, e.g., six rolls 1*a* (roll pairs) which are rotationally and partially drivingly supported in a segment upper frame 2 and a segment lower frame 3. The segment upper frame 2 and the segment lower frame 3 are adjusted in a sequential position-and/or pressure-controlled manner by pairs 4 of piston-cylinder units supported on a frame cross-members 5, with the sequence being determined by a casting direction 6*a* of a cast strand (6) (a slab strip being shown). At that, the operation is switched from position-controlled to pressure-controlled as soon a pressure within a respective pair 4 of piston-cylinder units reaches a predetermined maximum value.

Figure 1B:
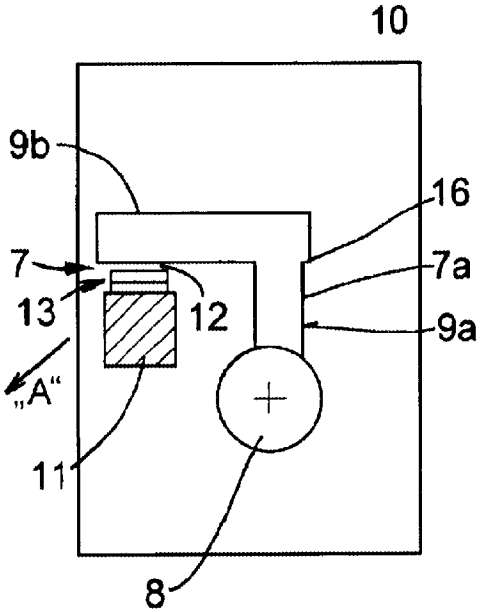
Figure 1A:
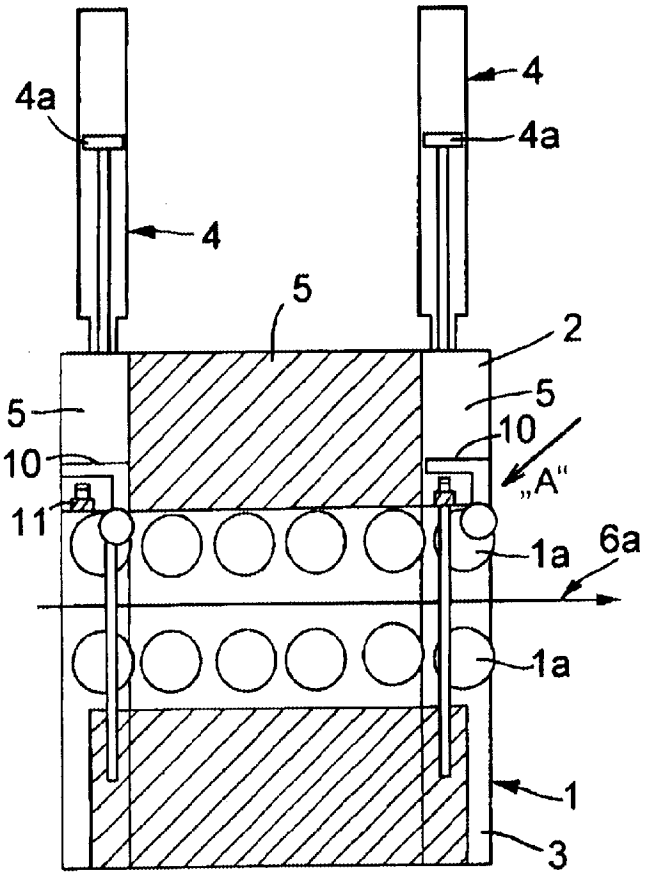
Figure 2B:
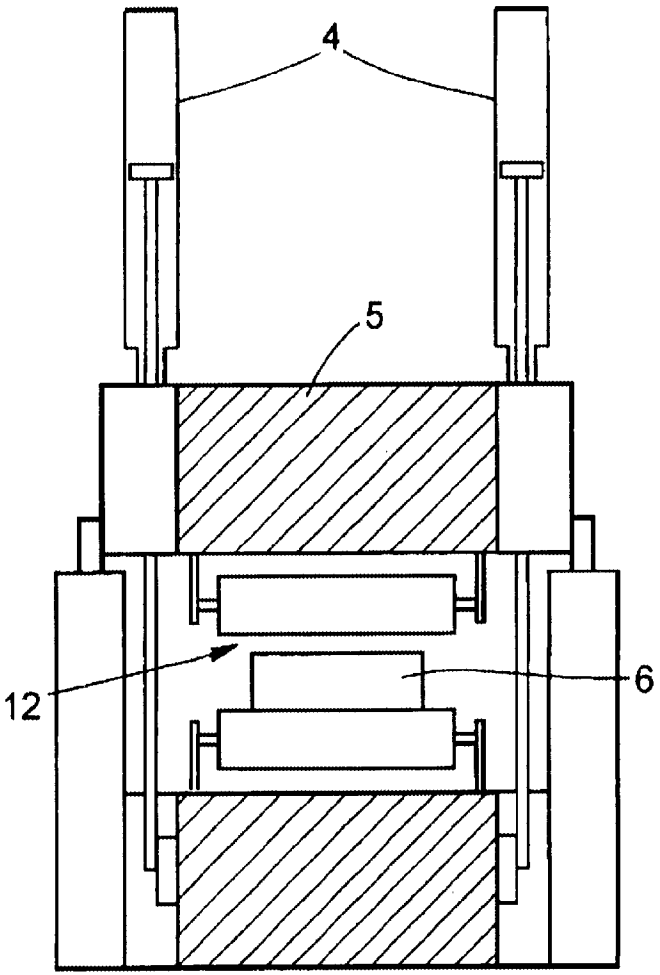
Figure 2A:
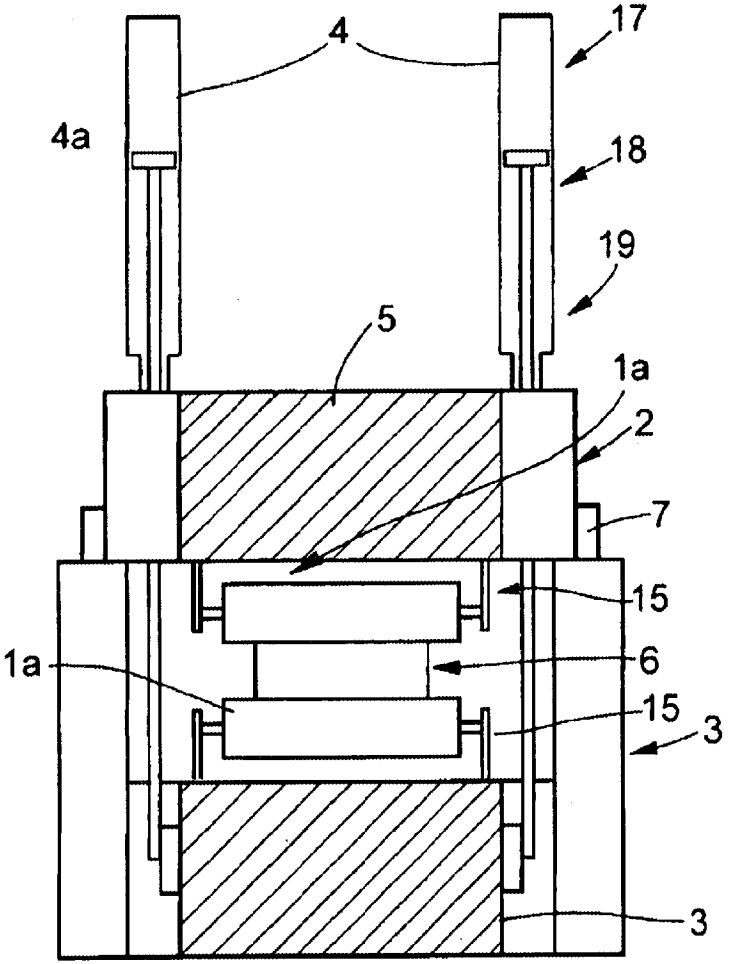

The cast strand 6 can be a slab strand or a bloom cross-section, e.g., a dog-bone profile. An adjustable displacement stop 7 (FIGS. 1B and 1C) is provided in a adjustment path of the segment upper frame. The adjustable displacement stop is generally arranged between the segment upper frame 2 and the segment lower frame 3. In unit "A", which is shown in FIG. 1B at an increased scale, the adjustable displacement stop 7 is formed as a toggle lever 7*a*. The toggle lever 7*a* is located immediately adjacent to a respective piston-cylinder unit (FIGS. 1A, 2A, 2B and FIGS. 5, 6, and 7). The toggle lever 7*a* is secured on the segment lower frame 3 with a pivot axle 8. In the embodiment shown in the drawings, the toggle lever 7*a* has a first lever arm 9*a* and a second lever are 9*b*. In a pivoted-in position 10 (FIG. 1B), an abutment 11, which is secured on the segment upper frame 2, lies opposite the toggle lever 7*a*. A plurality of shims 13 lie on the abutment 11, so that a maximum gap 12 is provided to the pivoted-in displacement stop 7. The gap 12 is not available in the locking position according to FIG. 2A and is clearly visible in FIG. 2B that shows it maximum size. In the locking position (FIG. 2A), the roller bearing 15, which forms part of a slide or rolling support, is subjected to a correspondingly high load.

The displacement stop 7 is simultaneously formed as an overload protection element 14. The toggle lever 7*a* is provided to that end with a predetermined breaking point 16.

Figure 3:
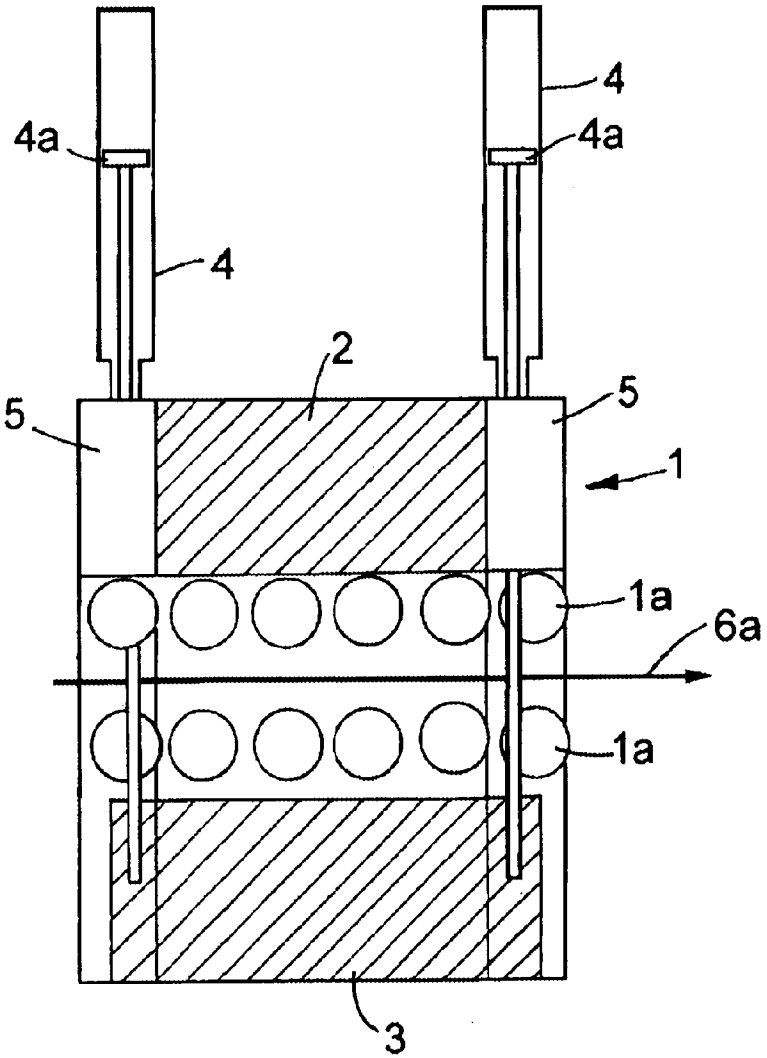

Without the displacement stop 7 (FIG. 3), the casting process would have been very inefficient because the withdrawn head of a withdrawn strand, a transition piece between the cold strand and the hot strand, a connection piece during the composite casting would have been differently charged, and a strand piece would have required a "softener" of the locking force, all of which would have required local regulation of the setting force which is possible only to a limited extent.

Figure 4B:
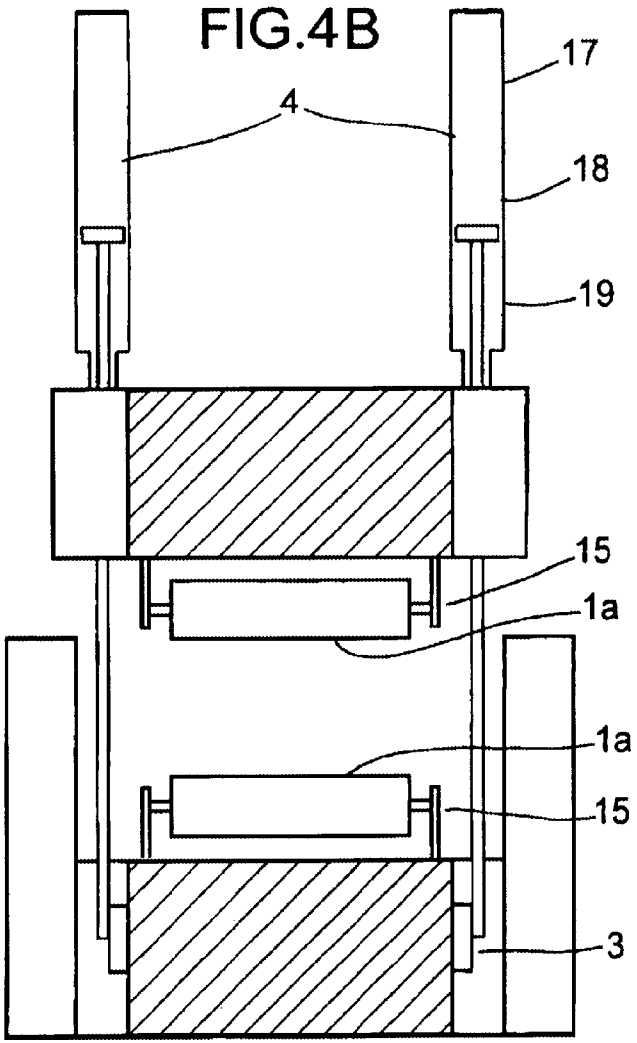
Figure 4A:
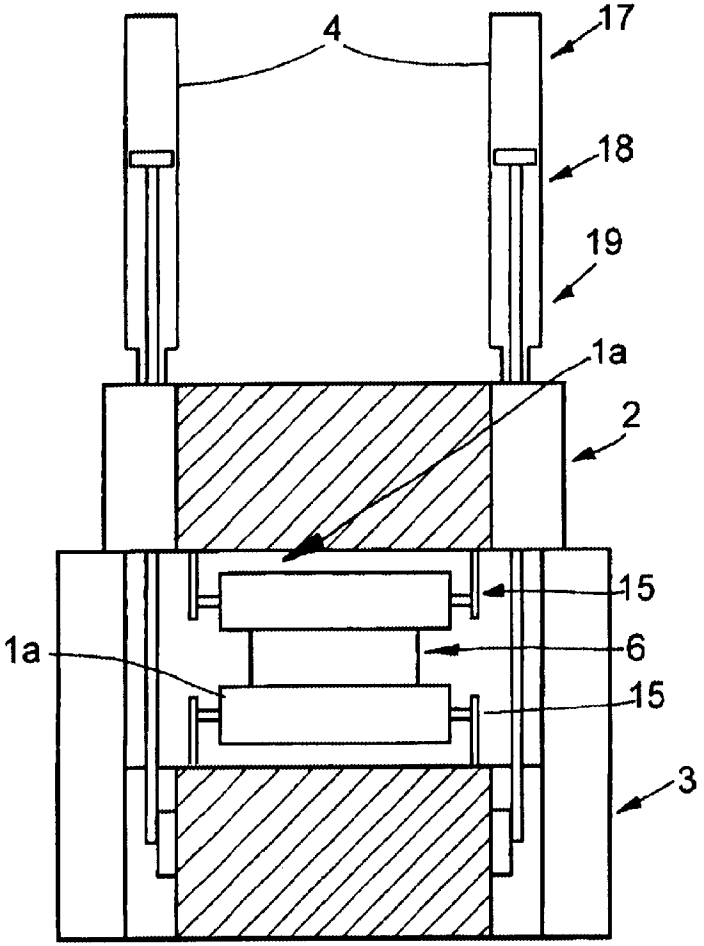

As can be seen in FIGS. 4A and 4B, without the displacement stop 7, the segment upper frame 2 with rolls 1*a* and the roller bearings 15 would have been pressed against the segment lower frame, and the cast strand 6 would have been pressed against its rolls, so that with strands having a non-uniform hardness, different high pressure forces would have been generated which only could have been absorbed by opening of the pressure chamber 17 of the hydraulic cylinder 18 by regulating the pressure of the hydraulic fluid in a lower pressure chamber 19 with so-called "softeners".

In case of a maintenance work, a complete opening of the segment upper frame 2 must take place in order to lift the segment upper frame 2 to a most possible extent, as shown in FIG. 4B.

Figure 5:
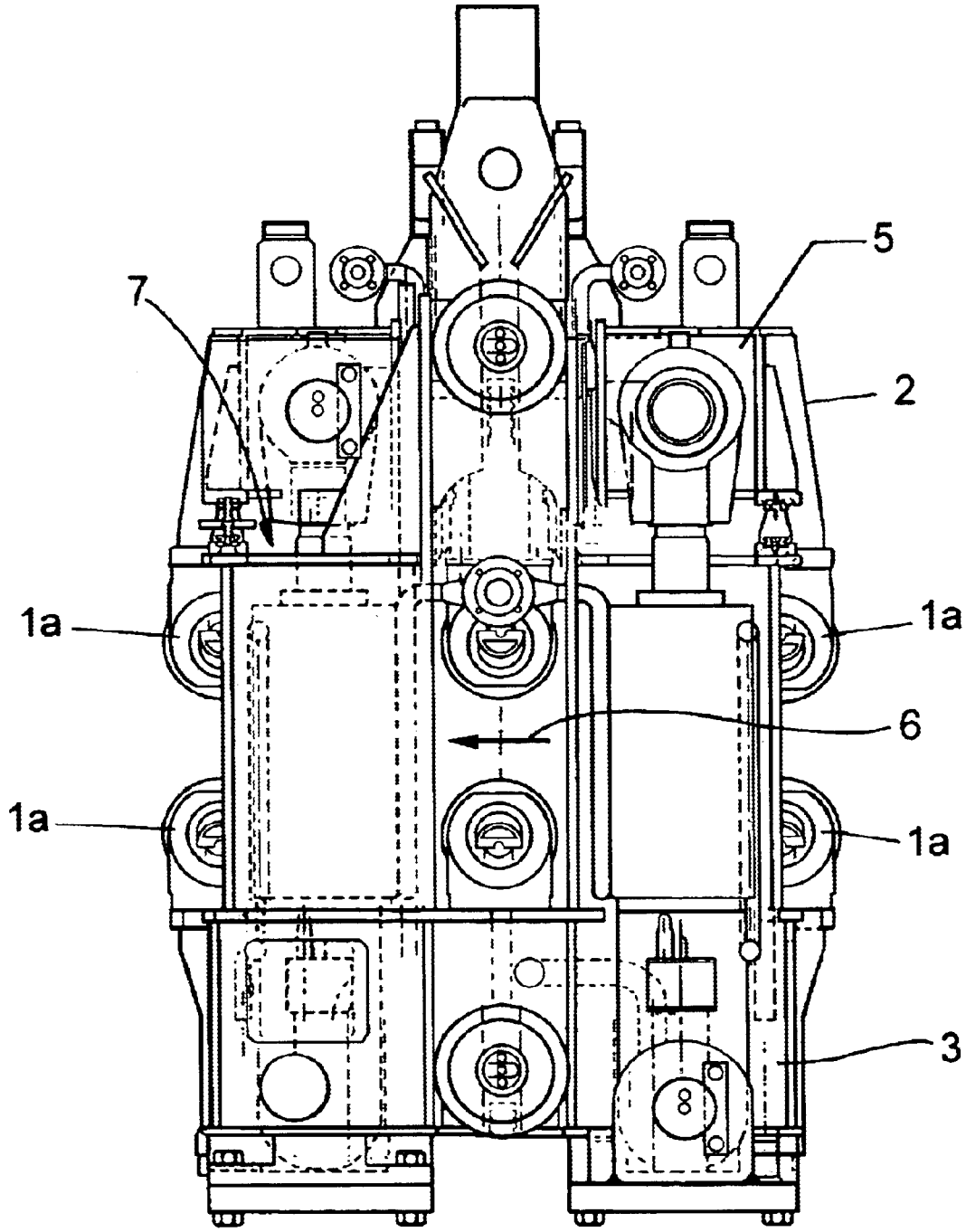
Figure 6A:
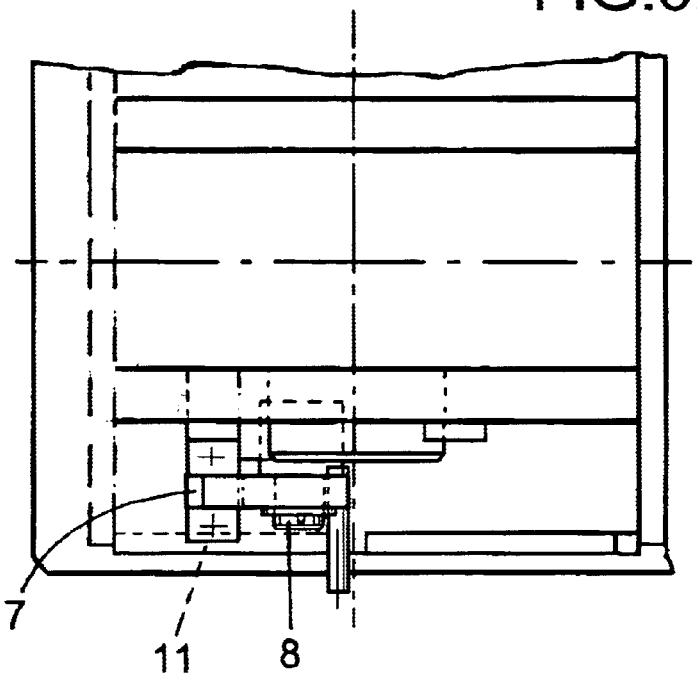
Figure 6B:
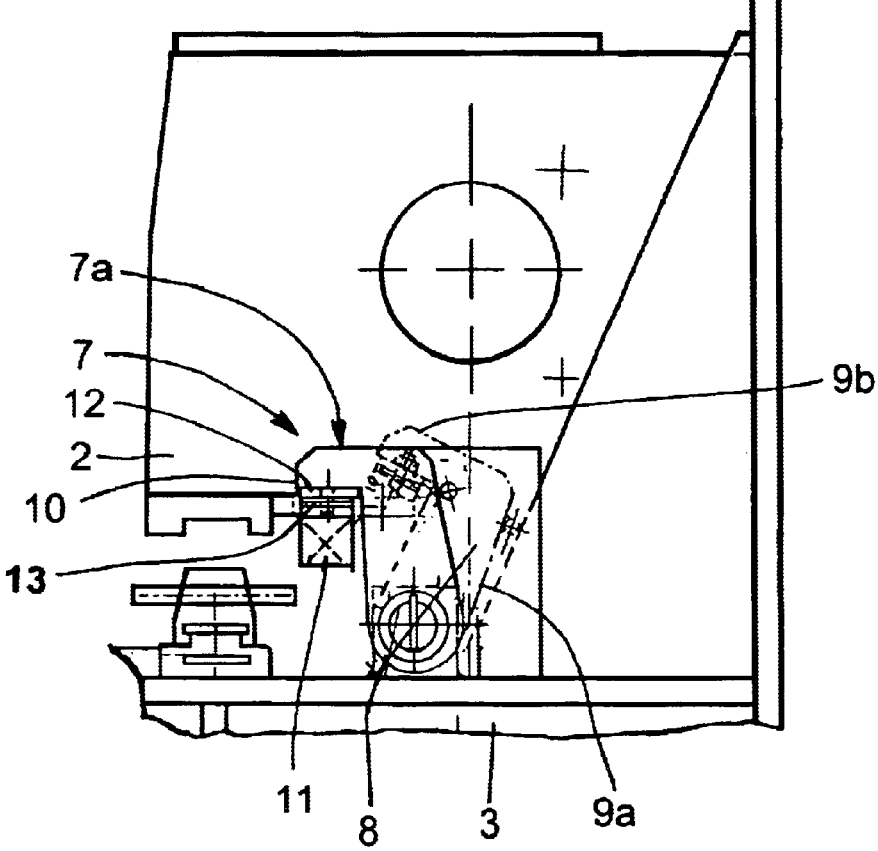

The location of the displacement stop 7 is represented in the embodiment shown in FIG. 5. In FIGS. 6A and 6B, the displacement stop 7 with its toggle lever 7*a* is shown in its pivoted-in position 10 and, with dash lines, in its pivoted-out position (FIG. 6B). The toggle lever 7*a* is supported in the segment lower frame 3 by an axle 8, and the abutment 7 is provided on the segment upper frame 2, with a plurality of shims 13 being stacked on the abutment 7. The shims 13 define a maximum available gap 12 by which the segment upper frame 2 can be displaced. Thereby, a very short displacement path of the segment upper frame 2 is insured.

List of Reference Numerals

1 Roll Segment
1*a* Rolls
2 Segment upper frame
3 Segment lower frame
4 Pairs of piston-cylinder units
5 Frame cross-members
6 Cast strand
6*a* Casting direction
7 Adjustable displacement stop
7*a* Toggle lever
8 Pivot axle
9*a* First lever arm
9*b* Second lever arm
10 Pivoted-in position
11 Abutment
12 Gap
13 Shims
14 Overload protection element
15 Roller bearing

16 Predetermined breaking point
17 Pressure chamber
18 Hydraulic cylinder
19 Lower pressure chamber

What is claimed is:

1. A method of adjusting roll segments (1) in a continuous casting installation for metal and rolls **(1*a*) of which are sequentially adjusted in a segment upper frame (2) and a segment lower frame (3) by pairs of hydraulic piston-cylinder units (4) supported on frame cross-members (5)** in position-controlled and pressure-controlled operations, the method comprising the steps of:

switching, in response to an overload, the piston-cylinder units (4) of each roll segment (1), in following each other steps, from the position-controlled operation to the pressure-controlled operation for effecting at least one of guiding and pressing a casting strand (6) when pressure within a respective pair of the piston-cylinder units (4) reaches a predetermined maximum value; and displacing the respective pair of the piston-cylinder units (4) in a pressureless switching mode until in the switching mode, a predetermined gap (12) between an abutment (11) provided on the segment upper frame (2) and a lever arm **(9*b*) of an adjustable displacement stop (7) that limits an adjustment path of the segment upper frame (2), is reached in a predetermined pivotal position (10) of the lever arm (9*b*), whereby a maximum gap between the roll segments and the strand (6)** is provided, with a locking force being provided by weight of the segment upper frame and friction forces of a relative displacement of cylinders and pistons of the piston-cylinder units.

2. A device for adjusting roll segments (1) in a continuous casting installation for metal and rolls **(1*a*) of which are sequentially adjusted in a segment upper frame (2) and a segment lower frame (3) by pairs of hydraulic piston-cylinder units (4) supported on frame cross-members (5) in position-controlled and pressure-controlled operations, wherein in response to an overload, the piston-cylinder units (4) of each roll segment (1) are switched, in following each other steps, from the position-controlled operation to the pressure-controlled operation for effecting at least one of guiding and pressing a casting strand (6) when pressure within a respective pair of the piston-cylinder units (4) reaches a predetermined maximum value, and the respective pair of piston-cylinder units (4)** is displaced in a pressureless switching mode, the device comprising:

an abutment (11) provided on the segment upper frame (2); and an adjustable displacement stop (7) for limiting an adjustment path of the segment upper frame (2) in the pressureless switching mode, the stop having a lever arm **(9*b*) that in a predetermined pivotal position (10) of the lever arm (9*b*), is spaced from the abutment (11) by a gap (12) providing for a maximum gap between the roll segments and the strand (6)**, whereby a continuous casting process can take place during the switching mode.

3. A device according to claim 2, wherein the displacement stop (7) is arranged between the segment upper frame (2) and the segment lower frame (3).

4. A device according to claim 2, wherein the displacement stop (7) is arranged in an immediate vicinity of every piston-cylinder unit (4).

5. A device according to claim 2, wherein the displacement stop (7) is formed as a pivoted-in and a pivoted-out toggle lever **(7*a*) a pivot axis (8) of which with a first lever arm (9*a*) of the toggle lever (7*a*) is supported on the segment lower frame (3), and wherein the gap-forming lever arm (9*b*) of the displacement stop (7) forms a second lever arm which lies below the segment upper frame (2) in the predetermined pivoted-in position (10)**.

6. A device according to claim 2, further comprising a plurality of shims (13) stackable on the abutment (11) of the segment upper frame (2) for forming a stepwise adjustable gap (12), and a number and thickness of which are selected individually on each segment upper frame (2) or on each piston-cylinder unit (4).

7. A device according to claim 5, wherein the toggle lever **(7*a*) simultaneously serves as an overload protection element (14)** and is provided with a breaking point.

* * * * *